US005442425A

United States Patent [19]

Yokoyama et al.

[11] Patent Number: 5,442,425

[45] Date of Patent: Aug. 15, 1995

[54] DEVELOPING APPARATUS

[75] Inventors: Tomoaki Yokoyama, Aichi; Makoto Takase, Toyokawa, both of Japan

[73] Assignee: Minolta Camera Kabushiki Kaisha, Osaka, Japan

[21] Appl. No.: 186,025

[22] Filed: Jan. 25, 1994

[30] Foreign Application Priority Data

Jan. 28, 1993 [JP] Japan ..... 5-012420

[51] Int. Cl.[6] ..... G03G 15/09

[52] U.S. Cl. ..... 355/251; 355/245; 430/108

[58] Field of Search ..... 355/245, 253, 251, 259; 118/658, 653, 657; 430/108

[56] References Cited

U.S. PATENT DOCUMENTS

| | | | |
|---|---|---|---|
| 3,939,801 | 2/1976 | Tanaka et al. | 118/658 |
| 4,331,100 | 5/1982 | Mochizuki et al. | 118/657 |
| 4,666,814 | 5/1987 | Suematsu et al. | 430/126 |
| 4,911,100 | 3/1990 | Yamashita | 118/658 |
| 4,960,070 | 10/1990 | Nishimura | 118/658 |
| 5,212,525 | 5/1993 | Noami et al. | 355/251 |

FOREIGN PATENT DOCUMENTS

| | | |
|---|---|---|
| 62-286063A | 12/1987 | Japan . |
| 63-161468A | 7/1988 | Japan . |
| 3-14178B2 | 2/1991 | Japan . |

*Primary Examiner*—A. T. Grimley
*Assistant Examiner*—Nestor R. Ramirez
*Attorney, Agent, or Firm*—Burns, Doane, Swecker & Mathis

[57] ABSTRACT

A twin magnetic pole type developing apparatus of the present invention includes a rotatable sleeve enclosing a non-rotatable magnetic member therein. The magnetic member has two magnetic poles of the same polarity which are positioned so as to confront a developing region in neighboring relation with each other. Developer material to be used is a two-component type developer material consisting of toner particles and carrier particles. Especially, the carrier particles have an average particle size of 25 μm or more and are capable of being magnetized to an intensity of magnetization of 30 emu/g or more. Further, a packing density in the developing region ranges from 5% to 40%. Consequently, the developer material can contact with an electrostatic latent image formed on a photoreceptor to develop it into the image of high density.

2 Claims, 6 Drawing Sheets

DEVELOPING APPARATUS

BACKGROUND OF THE INVENTION

1. Field of the Invention

The present invention relates to a developing apparatus for use in an electrophotographic image forming apparatus such as copying machine, laser beam printer, or facsimile, and more particularily to the developing apparatus for providing a photoreceptor with toner particles to develop an electrostatic latent image on the photoreceptor into a visible powder image.

2. Description of Related Art

There has been known a single-magnetic pole type developing apparatus in the art. The developing apparatus comprises a developer roller adjacent to the photoreceptor in order to apply a developer material onto the photoreceptor. The developer roller consists of a non-rotatably supported magnetic member having a plurarity of magnetic poles on its outer periphery with only one of said magnetic poles confronting the photoreceptor, and a rotatably supported sleeve enclosing the magnetic member therein. Developer material of two-component type, which is a mixture of toner particles and carrier particles, is magnetically retained on an outer periphery of the sleeve magnetically by the magnetic member and is transported during a rotation of the sleeve to a developing region where the sleeve confronts the photoreceptor. In the developing region, the developer material retained on the sleeve by the sole magnetic pole confronting the photoreceptor is brought into contact with the photoreceptor for developing the electrostatic latent image into a visible powder image.

However, the developing apparatus of this type has a drawback that the width of contact of the developer material with the photoreceptor with respect to the rotation of the sleeve is not so large that it is difficult to reproduce the electrostatic latent image into a visible powder image of high density.

SUMMARY OF THE INVENTION

It is therefore an object of the present invention to provide an improved developing apparatus for use in an image forming apparatus, which is capable of developing an electrostatic latent image into a visible powder image of high density.

To achieve the above and other objects of the present invention, the developing apparatus of the present invention comprises a rotatable sleeve facing a photoreceptor; a non-rotatable magnetic member disposed inside the sleeve and having a plurarity of magnetic poles extending in an axial direction thereof; and a regulating member facing the sleeve with a small gap left therebetween. Neighboring two of the magnetic poles of the magnetic member which are of the same polarity are positioned so as to confront the developing region. These two magnetic poles of the same polarity cooperate to produce a distribution of magnetic flux density having two peaks corresponding to the two magnetic poles and a local minimum point between the two peaks. Developer material to be used is a two-component type, which is a mixtute of toner particles and carrier particles. Preferably, the carrier particles have an average particle size of 25 μm or more, and are capable of being magnetized to an intensity of magnetization of 30 emu/g or more. Further, a packing density P.D (%) in the developing region ranges from 5% to 40%, which is defined as follows:

$$P.D = 100 \cdot M/(Ds \cdot \rho)$$

wherein:

M is the amount of the developer material transported on the sleeve per unit area ($g/cm^2$);

Ds is the distance of the gap between the sleeve and the photoreceptor; and $\rho$ is the weight of the developer material ($g/cm^3$)

According to the present invention, the developer material is retained by the effect of the magnetic member and transported by the rotation of the sleeve to a developing region at which it is brought into contact with the photoreceptor after having been regulated by the regulating member. In the developing region, the neighboring two magnetic poles of the same polarity constitute a twin magnetic-pole to form a repellent magnetic field. Consequently, the developer material transported to the developing region is restricted by the effect of the repelent magnetic field so as to from a reservoir, at a location adjacent one of the neighboring poles upstream of the other with respect to the direction of rotation of the sleeve. In this reservoir, the developer material is stirred and moved in rotational direction as well as an axial direction of the sleeve.

Further, since the developing apparatus uses carrier particles having an average particle size of not smaller than 25 μm and capable of being magnetized to an intensity of magnetization of not smaller than 30 emu/g, the developer material will be stirred vigorously by the effect of the repelent magnetic field. Moreover, since the packing density of the developer material in the developing region is set from 5% to 40%, the developer material stirred in the developing region contacts with the photoreceptor efficiently. Consequently, the developer material can sweep in contact with the electrostatic latent image formed on the outer periphery of the photoreceptor to develop it into the visible powder image of high density.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1:
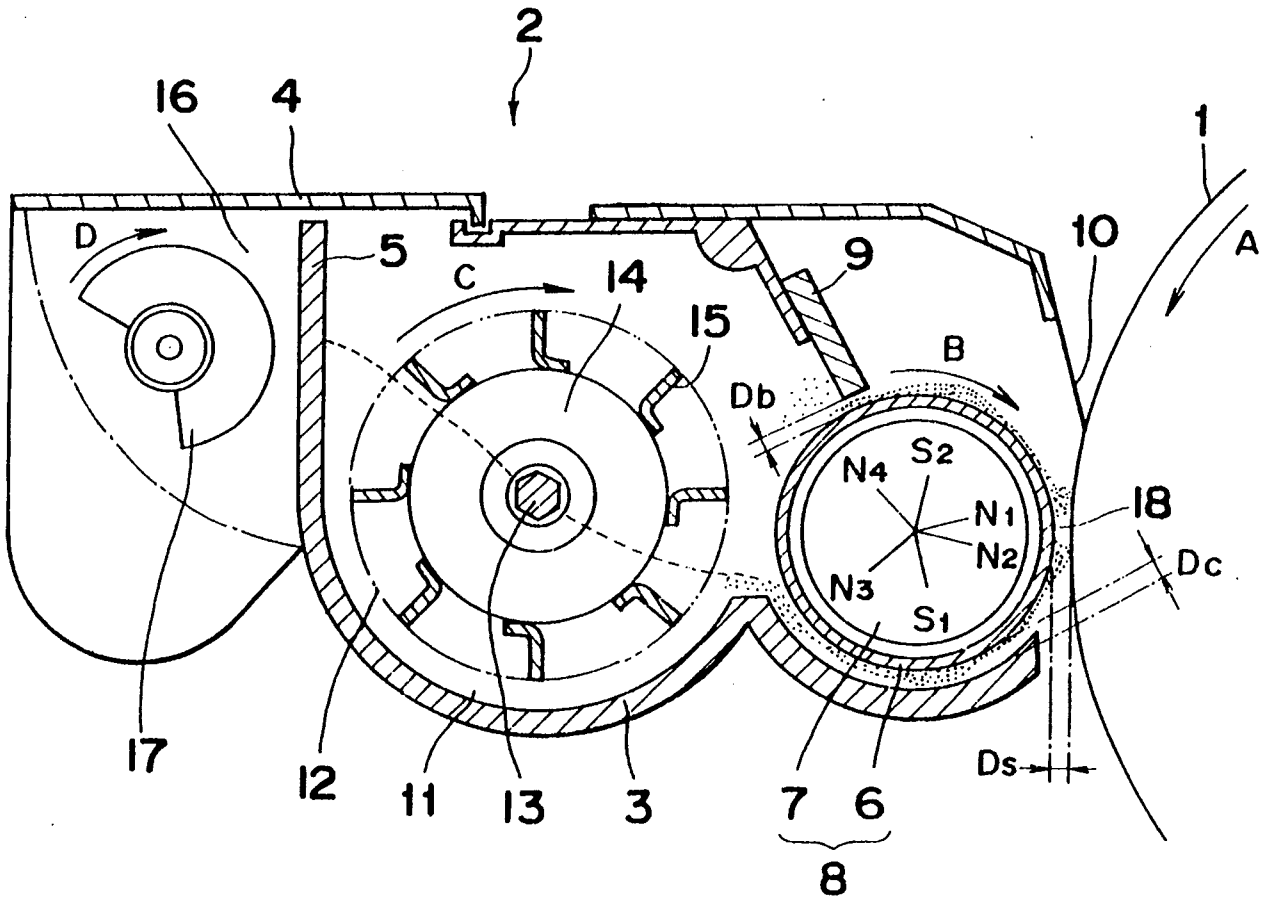
FIG. 1 is a schematic side sectional view of a developing apparatus according to the present invention.
Figure 2:
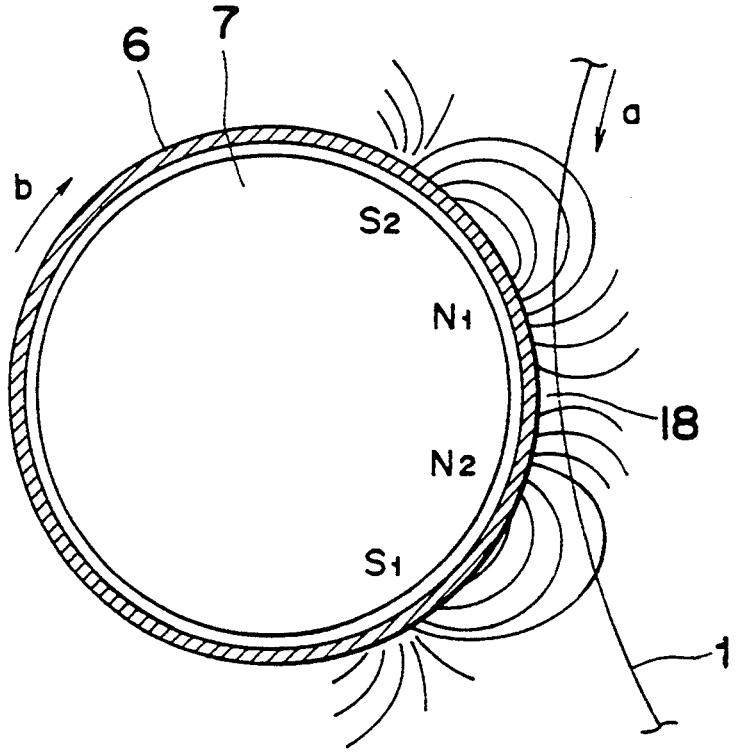
FIG. 2 shows a pattern of distribution of magnetic fluxes in a developing region.
Figure 3:
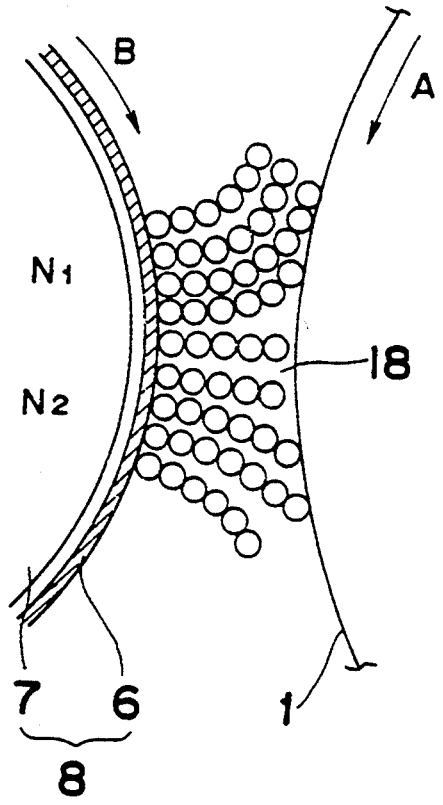
FIG. 3 is a partial sectional view, on an enlarged scale, showing the formation of magnetic brushes.

Referring now to the drawings, there is shown in FIG. 1 a transverse sectional view of an electorostatic latent image bearing member or photoreceptor 1. The photoreceptor 1 comprises a cylindrical body having an organic photosensitive layer on its outer surface, and supported for roation at a peripheral velocity of 180 mm/sec in a direction indicated by arrow A by suitable drive means or motor (not shown). Disposed arround the photoreceptor 1 are a plurality of image processing stations, that is, a charge station for imparting electric charge to the photosensitive layer, an exposing station for projecting an image onto the surface of the layer to form an electorostatic latent image, a developing station for providing the electrostatic latent image with toner particles to develop the latent image into a visible toner image, a transfer station for depositing the visible image onto a record material such as paper, a cleaning station for removing residual toner particles from the photoreceptor 1, and an erasing station for removing residual charge in readiness for the next succeeding cycle of copy making.

A twin-magnetic pole type developing apparatus 2 of the present invention, which is arranged at the developing station, comprises a developer tank consisting of a lower casing 3 and an upper casing 4, and houses therein a developer roller 8, a mixing roller 12, and a supply roller 17. The developer roller 8 comprises a cylindrical sleeve 6 having a stationary magnetic member 7 therein. The sleeve 6, which is made of electrically conductive, non-magnetizable material such as aluminium and formed into a cylinder having a diameter of,.e.g., 24.5 mm, has a multiplicity of fine surface irregularities formed on its outer surface by a sand blast process. This sleeve 6 is rotatably supported for rotation in a direction indicated by arrow B at a revolution rate of 226 rpm.

A developing gap Ds of 0.6 mm is defined between the sleeve 6 and the outer surface of the photoreceptor 1; and a clearance Dc of 1.0 mm is defined between the sleeve 6 and an arch-shaped front bottom portion of the lower casing 3. Installed at an inner portion of the upper casing 4 is a magnetic brush bristle height regulating member or plate 9, a free end of which is spaced apart from the upper portion of the sleeve 6 to define an air gap Db of 0.5 mm. Attached to a front portion of the upper casing 4 is a flexible sheet 10 preferably made of polyethylene. This flexible sheet 10 has its free end portion held in contact with the outer surface of the photoreceptor 1 to avoid a leak of dust of the toner particles out of the developer 2.

The magnetic member 7, made of magnetic material and having a column-like shape, has a plurality of magnetic poles N1, N2, S1, N3, N4 and S2 located at the outer periphery thereof in this sequential order in the direction indicated by arrow B. The magnetic pole N1 and the neighboring magnetic pole N2, which constitute a twin magnetic pole, are disposed so as to face a developing region 18 where the sleeve 6 confronts the photoreceptor 1. The magnetic poles N3 and N4 are disposed so as to orient towards the mixing roller 12 so that a repellent magnetic field is generated therebetween. The magnetic pole S1 is disposed between the magnetic poles N2 and N3; and the magnetic pole S2 is disposed between the magnetic poles N4 and N1.

The mixing roller 12, which is a conventional basket roller having an outer diameter of, for example, 36 mm, comprises a shaft 13, a plurality of paddles 14 mounted on the shaft 13, and a plurality of baskets 15 disposed arround the paddles 14 at a given interval. The mixing roller 12 is housed in a passage 11 formed on one side of the developer roller 8 remote from the photoreceptor 1, and is supported so as to rotate in a direction indicated by arrow C at a revolution rate of 240 rpm.

The supply roller 17, preferably in the form of a screw roller, is arranged in a supply passage 16 formed behind and on one side of the passage 11 remote from the sleeve 8 and supported so as to rotate in a direction indicated by arrow D at a revolution rate of 192 rpm. Formed between the passages 11 and 16 is a partition 5 which extends upwardly from the lower casing 3. This partition 5 has openings (not shown) defined in the vicinity of each side wall of the tank so as to communicate the passages 11 and 16 with each other.

The developer tank accommodates a mass of developer material composed of two components, namely, magnetic carrier particles of binder-type and insulative non-magnetic toner particles. When the two components are mixed together and stirred, the toner particles are triboelectrically charged to a negative polarity and the carrier particles are triboelectrically charged to a positive polarity.

In the twin-magnetic pole type developing apparatus 2 of the present invention, when the drive means such as motor (not shown) is activated, the sleeve 6, mixing roller 12, and supply roller 17 start rotation in the respective directions indicated by arrow B, C and D. Consequently, the developer material housed in the passage 16 is mixed and stirred by the rotation of the supply roller 17 while being tranported along the passage 16 in one direction, and then fed to the mixing passage 11 via one opening in the partition 5. The developer material accommodated in the passage 11 is further mixed and stirred by the continued rotation of the mixing roller 17 while being transported along the passage 11 in the opposite direction, and then fed to the passage via the other opening in the partition 5. Namely, the developer material circulates through the passages 11 and 16 by way of the openings while being thoroughly mixed and stirred. Thus, the toner particles and the carrier particles are triboelectrically charged to respective opposite polarities. For example, the toner particles are charged negative while the carrier particles are charged positive. During the circulation, part of the developer material in the passage 11 is successibly scooped upwardly by the baskets 15 of the mixing roller 12 and then supplied onto the developer roller 12 in the vicinity of the magnetic pole N4.

The developer material supplied to the developer roller 8 are retained on the outer surface of the sleeve 6 as magnetically attracted by the magnetic member 7, and is transported during the continued rotation of the sleeve 6 in the direction indicated by arrow B. The thickness of the developer material deposited on the sleeve 6 is restricted by the regulating plate 9 so that a specific amount of developer material can be transported through the air gap Db.

The developer material having passed through the gap Db is then carried by the sleeve 6 towards the developing region 18 opposing to the magnetic poles N1 and N2. On the other hand, the photoreceptor 1 rotating in the direction of arrow B also moves past the developing region 18 and, therefore, at the developing region 18, the developer material is applied to the photoreceptor 1 to develop an electorostatic latent image into a visible powder image. Residue of the developer material on the sleeve 6 is then transported in the direction indicated by arrow B by the continued rotation of the sleeve 6 and removed from the sleeve 6 in the region between the magnetic poles N3 and N4 by the effect of the repelent magnetic field formed by the magnetic poles N3 and N4. The developer material removed from the sleeve 6 is finally mixed with the developer material being transported in the passage 11.

Three experiments were made to examine how the image density of the developed image depends upon the average particle size of the carrier particles, the intensity of magnetization of the carrier particles, and the packing density in the developing region.

Figure 4:
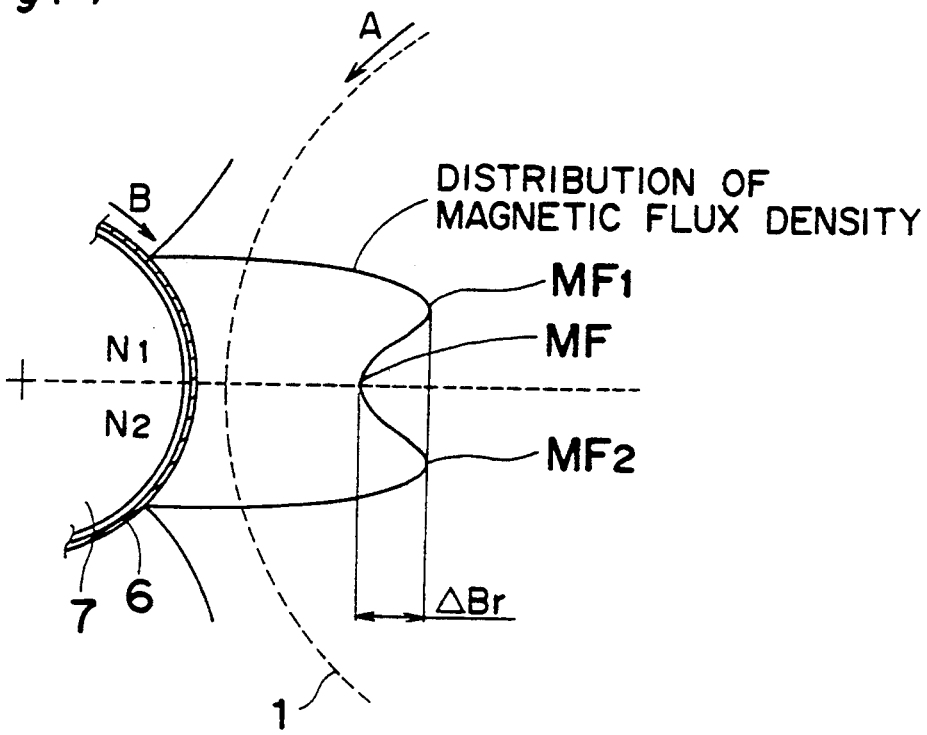
FIG. 4 shows a pattern of distribution of magnetic flux density in the developing region.

The first experiments made to clarify the relationship between the image density and the average particle size of the carrier particles will now be discussed. For this experiments, as shown in FIG. 4, the twin magnetic pole type developing apparatus of the present invention was so designed that the magnetic poles N1 and N2 were magnetized to give rise to the magnetic flux densities MF1 and MF2 of 1,000 G (G:gauss). Further, a drop of the magnetic flux density ΔBr, as defined below, which is a difference between the average magnetic flux density of the magnetic flux densities MF1 and MF2 and the magnetic flux density MF at a position intermediate between two magnetic poles N1 and N2, was set to 200 G.

$$\Delta Br=(MF1+MF2)/2-MF$$

wherein MF is a magnetic flux density at a position intermediate between the magnetic poles N1 and N2.

Several types of carrier particles having respective average particle sizes, which can be magnetized to the intesity of magintization of 30 emu/g, and the toner particles having an average particle size of 10 μm were prepared. Each type of the carrier particles was mixed with the toner particles in the proportion of 95 parts by weight of toner paricle with 5 parts by weight of carrier particle so as to make several types of developer materials containing carriers of respective particle sizes.

The twin-magnetic pole type developing apparatus accommodating each one of the developer materials was loaded in the image forming apparatus, and a predetermined test pattern was copied on a paper. Images reproduced on the papers using the different developer materials were then examined.

Figure 5:
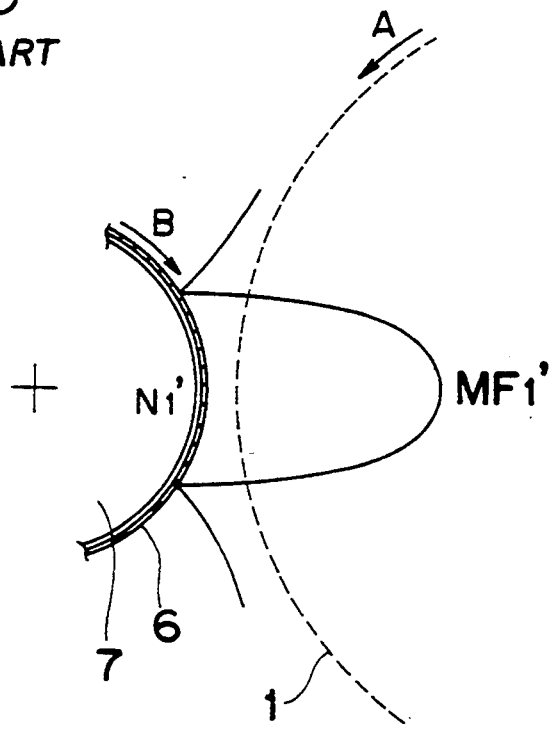
Fig. 5 PRIOR ART
FIG. 5 shows a pattern of distribution of magnetic flux density in the developing region of the single-magnetic type developing apparatus.

For comparison purposes, the single-magnetic pole type developing apparatus of the prior art as shown in FIG. 5, in which the magnetic flux density MF1′ of the magnetic pole N1′ confronting the developing region was set to 1,000 G, was loaded in the same image forming apparatus to reproduce the test pattern using each of the developer materials above described. Other conditions were identical to those employed during the test with the twin magnetic pole type developing apparatus.

Figure 6:
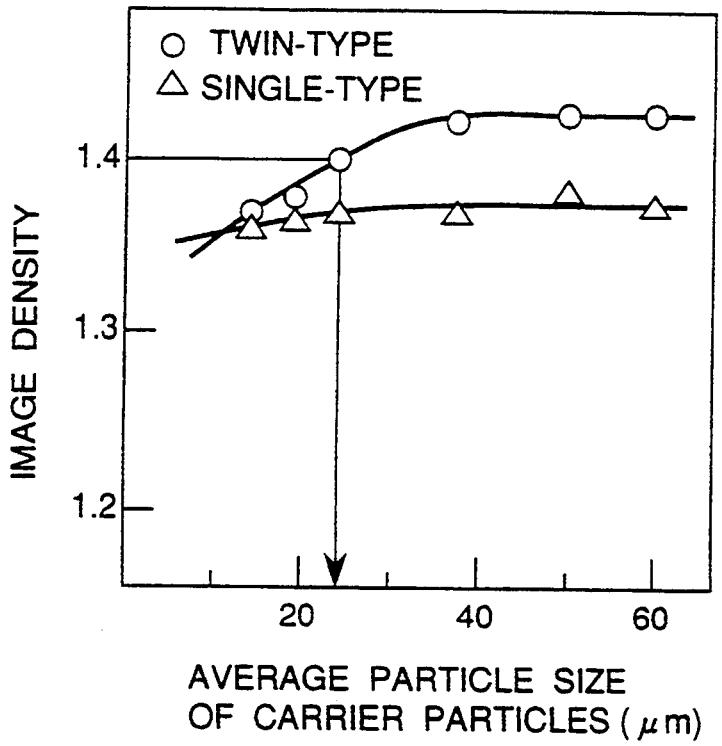
FIG. 6 is a graph showing the dependence of an image density on the average particle size of the carrier particles.

The result is shown in FIG. 6. This indicates that, in the twin-magnetic pole type developing apparatus of the present invention, if the average particle size of the carrier is under 40 μm, the image density increases with an increase of the average particle size. Further, when the carrier particles having the average particle size of 25 μm is used, the twin-magneic pole type developing apparatus will develop images having an image density of 1.4. This image density of 1.4 is one of the standards for estimating the quality of the reproduced image. That is, with respect to the image density, a reproduced image having the image density of more than 1.4, is regarded as a suitable image, while a reproduced image having an image density of less than 1.4 is regarded as an unsuitable image. FIG. 6 also indicates that, when the average particle size is over 40 μm, a high density image ranging from 1.42 to 1.43 can be obtained constantly. As for single-type developing machine, however, the image density does not increase so much with an increase of the average carrier particle size, as compared to that of twin-type developing apparatus, and the reproduced image density ranges from 1.36 to 1.38.

The second experiments were made to clarify the dependence of the image density upon the intensity of magnetization of the carrier particles. Several types of carrier particles, capable of being magnetized to different intensity of magnetization and having same average particle size of 25 μm, and toner particles identical to those used in the first experiments were prepared. Each of the carrier pariticles, after having been mixed with the toner pariticles in the same proportion as that in the first experiments, were accommodated in the twin-magnetic pole type developing apparatus and the single-magnetic pole type developing apparatus of the prior art so as to develop the test pattern.

Figure 7:
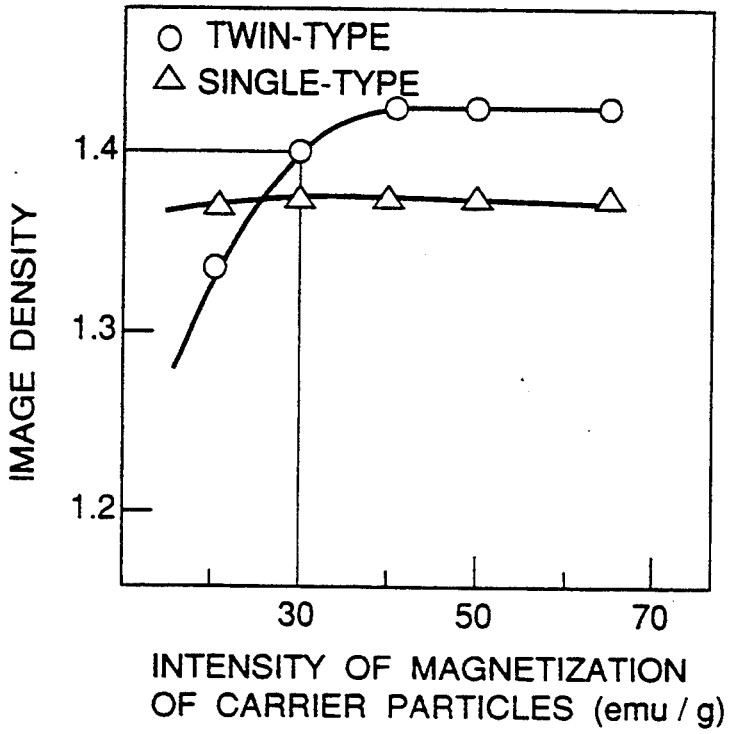
FIG. 7 is a graph showing the dependence of the image density on the intensity of magnetization of carrier particles.

The result is illustrated in FIG. 7. This proves that, as for the twin-magnetic pole type developing apparatus, when the intensity of the magnetization is under 40 emu/g, the image density considerably increases with an increase of the intensity of magnetization, and the image having the image density of 1.4 will be reproduced using carrier particles having the intensity of magnetization of 30 emu/g. Further, if the intensity of magnetization is over 40 emu/g, high density images having the image density of over 1.425 will be constantly reproduced. On the contrary, as for single-magnetic pole type developing apparatus, even thougth the intensity of magnetization increases, the image density does not increase too much, and the image density of the reproduced images are rather low and ranges from 1.365 to 1.375.

The first and second experiments suggest that, in order to form an image having a suitable image density of over 1.4 using the twin-magnetic pole developing apparatus, the developer material should contain carrier particles having the average particle size of 25 μm or more, and the intensity of magnetization of 30 emu/g or more. Otherwise, carrier particles will not receive the effect of the repelent magnetic field too much, which eventually result in a low efficiency of stirring of the developer material and a low frequency of contact of the developer material with the photoreceptor. Consequently, a required amount of toner particles for reproducing an image having suitable image density will not adhere to the electrostatic latent images, which results in fromation of low density images.

Furthermore, in the case of the twin-magnetic pole type developing apparatus, the image density of the reproduced image increases considerably with an increase of the average particle size of the carrier particles when it is under 40 μm, and with an increase of the intensity of magnetization when it is under 40 emu/g. However, in the case of the single-magnetic pole type devloping apparatus, the image density does not increase so much with an increase of the average particle size or an intensity of magnetization of the carrier particles.

This is because, in this single-magnetic pole type developing apparatus, the stirring of the developer material occurs only at the top of magnetic brushes which is brought into contact with the photoreceptor and does not depend upon the characteritics of carrier particles too much. On the contrary, in the twin-magnetic pole type developing apparatus, the developer material in the developing region is stirred wholly, and the extent of the stirring depends upon the average particle size and the intensity of the magnetization of the carrier pariticles.

The third experiments were made to clarify the dependence of the image density upon the packing density. The packing density P.D (%) is the density of developer material in the developing region between the sleeve and the photoreceptor and is defined by following equation:

$$P.D=100\cdot M/(Ds\cdot\rho)$$

wherein:

M is the amount of the developer material transported on the sleeve per unit area (g/cm$^2$);

Ds is the distance of the gap between the sleeve and the photoreceptor; and $\rho$ is the weight of the developer material (g/cm$^3$)

For this experiments, carrier particles having an average particle size of 25 $\mu$m and capable of being magnetized to the intensity of magnetization of 30 emu/g and toner particles identical to those used in the previous experiments were prepared. The carrier particles, after having been mixed with toner particles in the same proportion as that in the previous experiments, were accommodated in the twin-magnetic pole type developing apparatus so as to develop the test pattern. The packing density was changed by adjusting the developing gap Ds between the sleeve and the photoreceptor in these experiments. This can also be changed by adjusting the speed of revolution of the sleeve or regulating the gap Ds between the sleeve and the photoreceptor.

Figure 8:
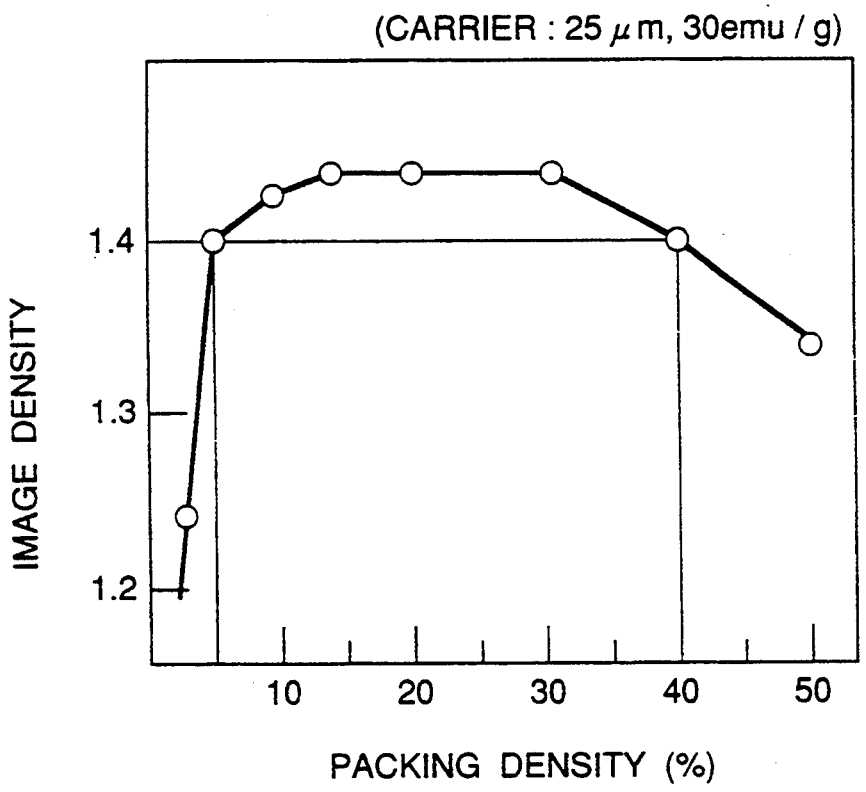
FIG. 8 shows a graph showing the dependence of the image density on the packing density.

The result of this experiment is shown in FIG. 8, in which a characteristics curve indicates the dependence of the image density upon the packing density. This curve shows a tendency that, when the packing density ranges from 5% to 15%, the image density increases with an increase of the packing density. The curve also shows a tendency that the image density decreases with increase of the packing density when it ranges from 15% to 30%. This is because an excess increase of the developer material in the developing region results in a decrease of both the stirring of the developer material and the frequency of contact of the developer material with the photoreceptor. The curve also indicates that the image having an image density of 1.4 can be reproduced if the packing density is within the range of 5% and 40%, and the image of about 1.44 can be obtained when the packing density ranges from 15% to 30%.

From the foregoing, it may be concluded that, in the twin-magnetic pole type developing apparatus of the present invention should employ the carrier particles both having an average particle size of 25 $\mu$m or more and capable of being magnetized to the intensity of magnetization of 30 emu/g or more, and further the packing density should be set from 5% to 40%, in order to reproduce the image of high density over 1.4. Preferably, the packing density should be set be within the range from 15% to 30% for obtaining an image of higher density than 1.4 stably.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A developing apparatus for developing an electrostaic latent image formed on an image bearing member into a powder image comprising;

a two-component type developer material consisting of toner particles and carrier particles;

a rotatable sleeve facing the image bearing member;

a stationary magnetic member having a plurality of magnetic poles extending in an axial direction thereof and disposed inside the sleeve; and a regulating member facing the sleeve with a small gap defined between it and the sleeve; and wherein the developer material is retained by an effect of the magnetic member so as to be transported by the rotation of the sleeve and regulated by the regulating member prior to being brought into contact with the image bearing member in a developing region where the sleeve confronts the image bearing member, characterized in that two of said magnetic poles which are of the same polarity are positioned so as to confront the developing region in a neighboring relation with each other;

said carrier particles have an average particle size of not smaller than 25 $\mu$m and are capable of being magnetized to an intensity of magnetization of not lower than 30 emu/g; and a packing density P.D (%) as defined below in the developing region ranges from 5% to 40%:

$$P.D=100\cdot M/(Ds\cdot\rho)$$

wherein:

M is the amount of the developer material transported on the sleeve per unit area (g/cm$^2$);

Ds is the distance of the gap between the sleeve and the photoreceptor; and $\rho$ is the weight of the developer material (g/cm$^3$).

2. A developing apparatus as claimed in claim 1, wherein said packing density in the developing region ranges from 15% to 30%.

* * * * *